US005195592A

United States Patent [19]

Simons

[11] Patent Number: 5,195,592

[45] Date of Patent: Mar. 23, 1993

[54] SPRINKLER HEAD HAVING CAP EJECTION SYSTEM

[75] Inventor: John R. Simons, Greendale, Wis.

[73] Assignee: Star Sprinkler Corporation, Milwaukee, Wis.

[21] Appl. No.: 771,747

[22] Filed: Oct. 4, 1991

Related U.S. Application Data

[63] Continuation-in-part of Ser. No. 594,056, Oct. 9, 1990, abandoned.

[51] Int. Cl.[5] ..... A62C 37/14

[52] U.S. Cl. ..... 169/37; 169/38

[58] Field of Search ..... 169/37-39, 169/40, 41, 19

[56] References Cited

U.S. PATENT DOCUMENTS

| | | | |
|---|---|---|---|
| 2,534,066 | 12/1950 | Rowley | 169/38 |
| 4,108,247 | 8/1978 | Mohler | 169/38 |
| 4,167,974 | 9/1979 | Job | 169/38 |
| 4,991,656 | 2/1991 | Polan | 169/38 |

*Primary Examiner*—Charles A. Marmor
*Assistant Examiner*—James M. Kannofsky
*Attorney, Agent, or Firm*—Andrus, Sceales, Starke & Sawall

[57] ABSTRACT

A sprinkler head including a frame or body having an opening to be connected to a water line. The body also includes a pair of arms which are joined together at a junction. A cap encloses the opening and a releasable mechanism, such as a frangible glass bulb, is connected between the junction and cap. When the sprinkler head is exposed to an elevated temperature, the glass bulb will fracture releasing the cap to permit water to be discharged from the opening. The sprinkler head includes an ejection mechanism which prevents the cap from hanging up on the arms. The ejection mechanism has a base connected to a projection on the upstream side of the cap and a skirt extends longitudinally from the base and terminates in a thin edge facing upstream. When the cap is released by fracture of the bulb, the water pressure will force the cap axially and when the cap strikes the arms the cap will tilt slightly causing the water pressure to then act against the side surface of the skirt to provide a rapid tilting and ejection of the cap from the frame.

18 Claims, 2 Drawing Sheets

FIG. 1
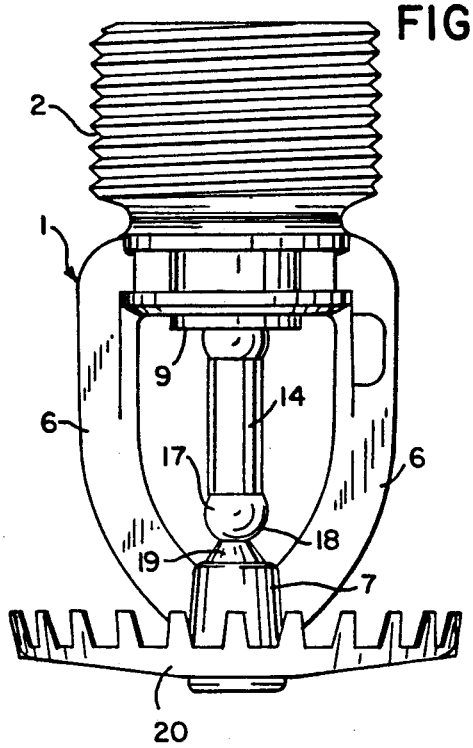
FIG. 2
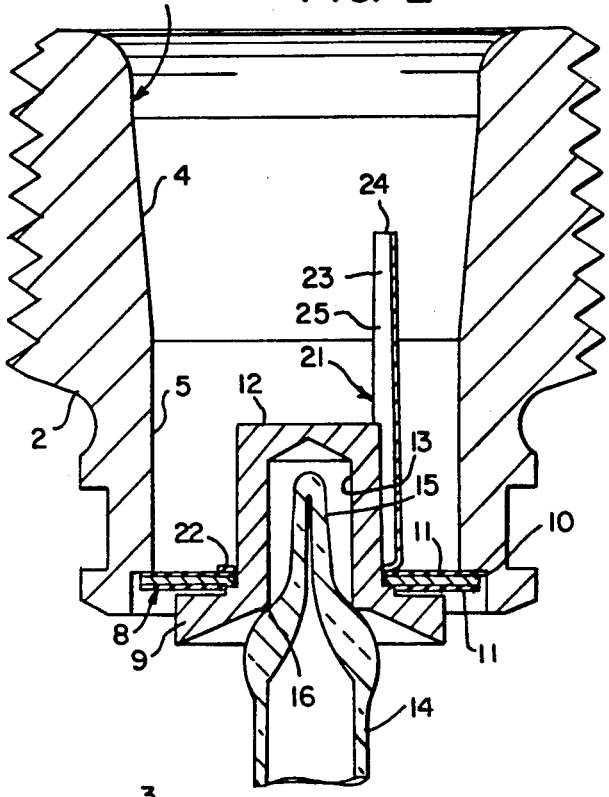
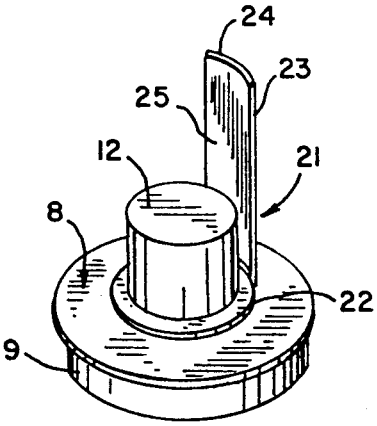
FIG. 3
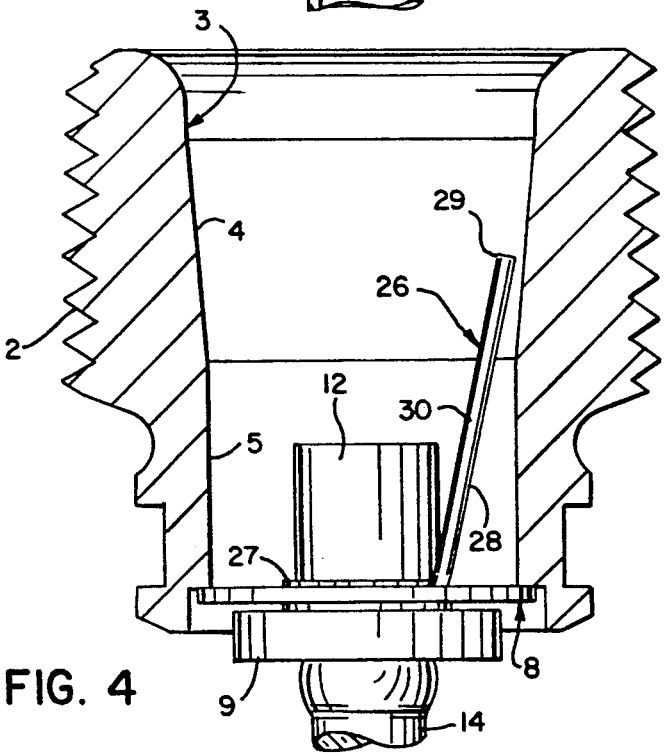
FIG. 4

FIG. 5
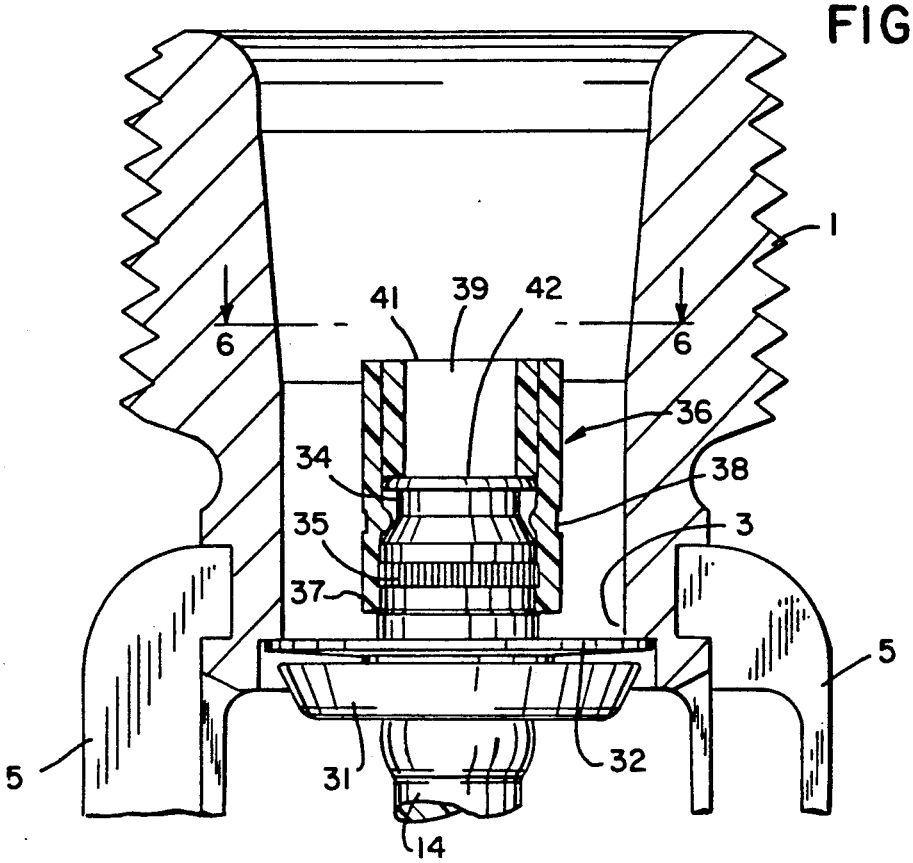
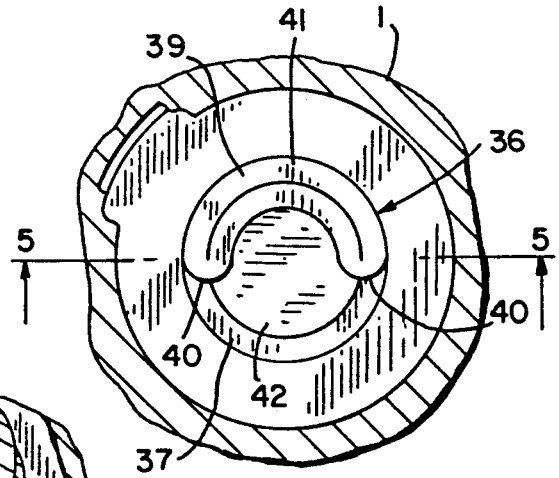
FIG. 6
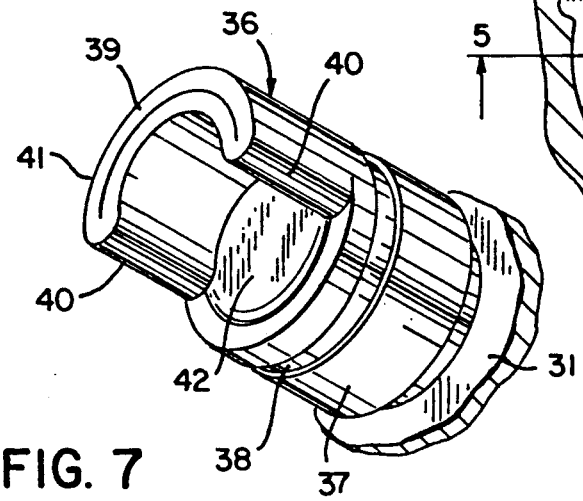
FIG. 7

SPRINKLER HEAD HAVING CAP EJECTION SYSTEM

RELATED APPLICATION

This application is a continuation-in-part of application Ser. No. 07/594,056, filed Oct. 9, 1990, now abandoned and entitled Sprinkler Head Having Cap Ejection Device.

BACKGROUND OF THE INVENTION

The typical sprinkler head includes a body or frame having an opening connected to the water line. The frame also includes a pair of arms which extend outwardly and are joined together at a junction. A cap encloses the opening in the frame and a releasible mechanism interconnects the cap and the junction and maintains the cap in a closed position. The releasable mechanism may take the form of a frangible glass bulb, or alternately, a lever mechanism including a fusible metal, such as solder. When the release mechanism is exposed to a predetermined elevated temperature, the mechanism will release, enabling the water pressure to dislodge the cap, and the water will then be directed against a deflector mounted on the junction which will deflect or spray the water outwardly in the desired spray pattern.

It has been found that when the frangible bulb ruptures to release the cap, the water pressure will force the cap axially and the cap has a tendency to lodge against the arms of the frame with the result that the water cannot contact the deflector and the desired spray pattern is not obtained.

Because of this, attempts have been made in the past to include an ejection device with the sprinkler head, so that the cap will be moved laterally as it is released by the water pressure and will not hang up on the arms of the frame. In this regard, it has been proposed to machine off-centered grooves in the upstream surface of the cap, so that the center of mass of the cap is offset from its axis. However, the machining operation is expensive and it is necessary to properly orientate the machined grooves when assembling the sprinkler head, which is a tedious, labor intensive operation.

It has also been proposed to connect a plastic member to the upstream surface of the cap having an inclined upstream facing surface. With this construction, when the cap is released, the water pressure acting against the inclined surface is intended to deflect the cap slightly laterally. However, it has been found that the time required for movement of the cap from its closed position to a position where it engages the arms is extremely short, with the result that the water pressure acting on the inclined surface does not have sufficient time to move the cap laterally.

Other attempts to influence the discharge of the cap have included a wire form which is attached to the frame and bears against the cap. The biasing pressure of the wire form, on release of the cap, will tend to move the cap laterally. However, a wire form is expensive and is difficult to assemble with the sprinkler head and also is not aesthetically pleasing.

A further attempt to influence the discharge of the cap has involved the riveting of a small lug in a slot in the frame with the edge of the lug engaging the side of the cap. However, this construction is expensive requiring two additional parts and also involves considerable labor for assembly.

SUMMARY OF THE INVENTION

The invention is directed to a sprinkler head construction having an improved ejection mechanism which acts to influence the discharge of the cap and prevent the cap from hanging up on the arms of the frame. The invention has particular application to a sprinkler head that utilizes a frangible glass bulb release mechanism, but can also be utilized with sprinkler heads employing a mechanical lever release system including a fusible metal or solder.

In accordance with the invention, the upstream facing surface of the cap is provided with a central annular projection and the ejection mechanism includes an annular base which is press fitted around the projection on the cap. The device also includes a longitudinally extending skirt, which is connected to the base and is partially cylindrical with the result that the skirt is nonsymmetrical with respect to the axis of the cap. The distal or upstream end of the skirt terminates in a relatively thin edge which provides a small frontal area that is exposed to the water pressure when the cap is released.

When the release mechanism is released, by exposure to a predetermined elevated temperature, the water pressure acting on the upstream surface of the cap, as well as on the thin upstream edge of the skirt, will move the cap axially until the cap strikes the arms on the frame. This contact will tend to slightly jiggle the cap, thus tilting the skirt, so that the water pressure is then directed against the large surface area of the skirt. This drastic change in frontal area, which is exposed to the water pressure, will then rapidly tilt the skirt and the cap to dislodge the cap and prevent the cap from hanging up on the arms of the sprinkler head.

In a modified form of the invention, the skirt diverges outwardly with respect to the axis of the opening in the sprinkler head and the distal end of the skirt is located adjacent the tapered wall of the opening. On release of the cap, the distal end of the skirt will contact the tapered wall causing the skirt and cap to tilt and the water pressure will then be directed against the large surface area of the skirt, thus further tilting the skirt and the cap as the skirt exits from the opening in the body or frame.

In a further modified form of the invention, the outer surface of the cap is provided with a circumferential groove and the base of the ejection device has a circular rib or crimp which is engaged with the groove to mechanically lock the ejection device against axial movement relative to the cap. In addition, the outer surface of the cap, adjacent the groove, is provided with surface deviations, such as knurling, which act to lock the base of the ejection device against rotation, thereby maintaining the skirt of the ejection device in proper position relative to the arms of the sprinkler head to provide the desired ejection of the cap on release of the cap.

The invention provides a simple and inexpensive device which will ensure that the cap, when released, will not hang up or lodge against the arms of the frame or body.

The ejection device is a one-piece construction formed of a metal or plastic.

The device has distinct advantages over ejection devices utilizing an inclined surface on the upstream surface of the cap. The water pressure acting on an inclined cap surface will tend to move the cap gradually in a diverging path. However, with the invention, a slight tilt of the skirt will provide a drastic change from a thin edge frontal area to a large side surface frontal area which will rapidly tilt the cap to prevent the cap from lodging on the arms of the body.

Other objects and advantages will appear in the course of the following description.

DESCRIPTION OF THE DRAWINGS

The drawings illustrate the best mode presently contemplated of carrying out the invention.

In the drawings:

FIG. 1 is a side elevation of a sprinkler head incorporating the invention;

FIG. 2 is a longitudinal section of the sprinkler head;

FIG. 3 is a perspective view of the cap and ejection device;

FIG. 4 is a longitudinal section similar to FIG. 2 and showing a modified form of the ejection device;

FIG. 5 is a fragmentary longitudinal section of a modified form of the sprinkler head of the invention;

FIG. 6 is a view taken along line 6—6 of FIG. 5; and

FIG. 7 is a perspective view of the cap and ejection device of FIG. 5.

DESCRIPTION OF THE ILLUSTRATED EMBODIMENT

FIGS. 1-3 illustrate a sprinkler head incorporating the ejection mechanism of the invention. The sprinkler head includes a cast metal body or frame 1 including a tubular section 2 which is to be threaded to a water supply line, not shown. Section 2 defines an opening or outlet 3 having an upstream tapered section 4 and a downstream section 5 which is generally cylindrical.

Frame 1 also includes a pair of arms 6 which are connected to section 2 and the outer ends of the arms are connected together at a junction 7.

A seal assembly 8 is adapted to close off the opening 3 and is retained in the closed position by a cap 9. Seal assembly 8 can include a Bellville spring 10 with a layer of plastic material, such as polytetrafluoroethylene 11, on each surface. As shown in FIG. 2, the inner or upstream surface of cap 9 is formed with a cylindrical projection 12 and the projection defines a central recess or well 13.

A releasible mechanism is connected between cap 9 and the junction 7, and as shown in the drawings. the releasible mechanism can take the form of a frangible glass bulb 14 which is filled with a suitable liquid. As illustrated in FIG. 2, the closed or crimped tip 15 of the bulb is located in the well 13 and is spaced from the bottom of the well, while the shoulder 16 of the bulb engage the portion of the cap bordering the well. The opposite end 17 of the bulb is in engagement with a recess 18 in the tip of an adjusting screw 19 which is threaded within an opening in junction 7. By threading the screw 19, the compressive force on the bulb can be varied.

Bulb 14 is a standard type, and in itself forms no part of the invention. When the bulb is exposed to an elevated temperature, it will fracture thus enabling the water pressure in the water line to dislodge the seal assembly 8 and cap 9. The water being discharged from the opening 3 will then strike a deflector plate 20, which is mounted on junction 7 and be deflected outwardly in the desired spray pattern.

It has been found that when the cap 9 is released, the water pressure has a tendency to drive the cap axially and the cap may tend to lodge or catch on the arms 6, or the well 13 in the cap may hang up on the tip of the adjusting screw 19 with the result that the cap is not displaced from the sprinkler head and the water cannot properly contact the deflector plate 20. Thus, the desired spray pattern is not obtained.

In accordance with the invention, an ejector mechanism 21 is incorporated with the sprinkler head which will ensure that the cap will not hang up on the frame 1 and will be discharged laterally. The ejection mechanism is preferably formed of a thin metal such as copper and includes an annular base 22 which is press fitted over the projection 12 on the upstream surface of cap 9. The ejection mechanism also includes a partially cylindrical elongated skirt 23 which extends longitudinally from base 22 to a location upstream of projection 12, as seen in FIG. 2. As shown in FIGS. 2 and 3, skirt 23 is disposed longitudinally of the axis of opening 3 and terminates in a thin upstream edge 24.

When bulb 14 fractures on exposure to a predetermined elevated temperature, the water pressure in opening 3 will act against the upstream surface of cap 9, as well as against edge 24 of the ejection mechanism to dislodge the cap and move the cap axially. When the cap strikes the arms 6, it will tend to jiggle or slightly tilt and the water being discharged from opening 3 will then be directed against the one of the side surfaces 25 of the skirt. The surface area of surface 25 is substantially greater than the area of edge 24. The drastic change from the frontal area of edge 24 to the frontal area of surface 25 will rapidly flip the skirt and cap outwardly to prevent the cap from hanging up on the arms 6 or screw 19.

Skirt 23 is asymmetrical with respect to the base 22 and it is preferred that the width of the skirt be greater than the diameter of the opening in base 22, so that the skirt of one device cannot be received within the opening in the base in a second device when the devices are packaged.

FIG. 4 illustrates a second embodiment of the invention which includes a modified ejection device 26. Device 26 includes an annular base 27, similar to base 22, which is press fitted around the projection 12 on cap 9. An elongated partially cylindrical skirt 28 extends longitudinally of the base 27, as shown in FIG. 4. Skirt 28 diverges outwardly in an upstream direction with the upstream or distal end 29 of the skirt being located adjacent the tapered wall section 4 of opening 3. The angle of taper or divergence of skirt 28 is greater than the angle of taper of section 4. Because of this, when the bulb 14 fractures and the cap 9 is released, the distal end 29 of the skirt will initially engage the tapered wall 4 causing the skirt 28 and attached cap 9 to tilt. This tilting action will cause the water stream to be directed against the side surface 30 of the skirt, resulting in a rapid further tilting of the cap and skirt as the skirt emerges from the opening 3 to prevent the cap from hanging up on the frame.

FIGS. 5-7 show a further modified form of the invention, including a cap 31, which is similar in construction and function to cap 9, and serves to retain a seal assembly 32, similar to seal assembly 8, in the sealing position relative to opening 3 of frame 1. An end of cap 31 is provided with a central recess or well, not shown, but similar to well 13, which receives the end of the glass bulb 14.

Formed in the outer peripheral surface of cap 31 is a circumferential groove 34, and the portion of the outer surface of cap 31 adjacent groove 34 is formed with surfaces deviations, such as knurling 35.

An ejection device 36 is secured to the upstream end of cap 31 and the ejection device can either be formed of a metal, such as copper, or plastic. As illustrated in FIGS. 5–7, the ejection device is formed of metal.

Ejection device 36 includes an annular base 37 which is disposed around the upstream end of cap 31 and base 37 is provided with an inwardly extending crimp or rib 38 which is received in groove 34 and serves to mechanically lock the base to the cap and prevent axial displacement of the ejection device from the cap. In certain installations, such as factories, the sprinkler head may extend upwardly from the water line, and thus the upstream end of the cap will face downwardly. In this type of installation, the ejection device 36 may loosen from the cap 31 due to handling or vibration and be dislodged from the cap. However, with the interconnection of crimp 38 with groove 34, displacement of the ejection device from the cap is prevented.

The ejection device 36 also includes a partially cylindrical skirt 39 which, as shown in FIGS. 6 and 7, has a double wall construction. Skirt 39 extends through slightly more than 180° and has a pair of generally parallel longitudinal side edges 40, which terminate in an end edge 41. The double wall construction of skirt 39 increases the weight of the skirt relative to the base 37 and provides a greater offset of the center of gravity of the ejection device from its axis to increase the tilting action of the skirt and cap under the influence of water pressure on release of the sprinkler head.

The ejection device is preassembled to the cap by initially inserting one end of a cylindrical metal tube around the knurled end of cap 31. The tube is then subjected to a shear, form and crimping operation, which shears a portion of the tube along the flat end 42 of the cap and forms the sheared portion into the double wall skirt 39 which consists of a pair of arcuate skirt sections disposed in contiguous relation with the side edges 40 of the skirt sections being joined together. Simultaneously, the outer periphery of the metal tube is deformed inwardly to form the crimp 38 which engages groove 34, and this operation also firmly engages the inner surface of the metal tube with the knurl 35 to lock the ejection device 36 against rotation relative to cap 31.

The cap/ejection device pre-assembly is then assembled with the seal assembly 32 and bulb 14, to the frame of the sprinkler head. In this assembly, the skirt 39 is preferably located so that the arcuate configuration of the skirt extends in a direction generally parallel to a plane passing through the arms 6 of the sprinkler head.

With the construction shown in FIGS. 5–7, the ejection device is locked against both axial and rotational movement relative to the cap, thus ensuring that the ejection device can be properly positioned with respect to water outlet 3 and arms 6 of the frame to obtain the most effective ejection action for the cap 31.

While the drawings have illustrated the release mechanism to be in the form of a frangible bulb 14, it is contemplated that the release mechanism may also be a mechanical lever type which includes a fusible metal or solder that will melt when exposed to an elevated temperature to thereby release the lever mechanism.

The invention provides a simple and inexpensive mechanism which will positively influence the discharge of the cap and prevent the cap from hanging up on the frame.

Various modes of carrying out the invention are contemplated as being within the scope of the following claims particularly pointing out and distinctly claiming the subject matter which is regarded as the invention.

I claim:

1. In a sprinkler head construction, a frame including conduit means to be connected to a source of water under pressure, said frame also including a pair of arms extending outwardly from said conduit means and connected together at a junction, sealing means closing said conduit means, releasible means connected between said sealing means and said junction, said releasible mens being releasible at a predetermined elevated temperature to thereby permit said sealing means to be displaced from said conduit means under the pressure of said water, and ejection means connected to the upstream end of said sealing means and including an elongated section extending longitudinally of said conduit means and being asymmetrical with respect to the axis of said conduit means, said section having inner and outer cylindrical surfaces and longitudinal side edges connecting said inner and outer cylindrical surfaces and disposed generally parallel to the axis of said conduit means, said section terminating in an edge facing upstream.

2. The construction of claim 1, wherein said elongated section is partially cylindrical in cross section.

3. The construction of claim 1, wherein the upstream end of said sealing means is provided with a projection and said ejection means includes a base section secured to said projection, said elongated section extending upstream from said base section.

4. The construction of claim 3, and including means for preventing axial movement of said base section relative to said projection.

5. The construction of claim 4, wherein said means for preventing axial movement of said base comprises a groove formed in said projection and an internal rib on said base section engaged with said groove.

6. The construction of claim 3, and including means for preventing relative rotation between said base and said projection.

7. The construction of claim 6, wherein said means for preventing relative rotation comprises a plurality of surface deviations on an outer surface of said projection and engaged with and inner surface of said base section.

8. In a sprinkler head construction, a frame including conduit means to be connected to a source of water under pressure, said frame also including a pair of arms extending outwardly from said conduit means and being connected together at a junction, cap means for closing said conduit means, releasable means interconnecting said cap means and said junction and constructed and arranged to be released when exposed to a predetermined elevated temperature, said cap means having an upstream facing surface and having a projection extending upstream from said surface, an ejection device including an annular base section secured to said projection and an elongated section extending upstream from said base section beyond said projection, said elongated section being a part of a right circular cylinder and extending no more than about 180°, said elongated section having a pair of longitudinal side edges disposed generally parallel to the axis of said conduit means and terminating in an edge facing upstream.

9. The construction of claim 8, wherein said releasable means comprises a frangible bulb containing a liquid.

10. The construction of claim 9, wherein said cap means also includes downstream surface and said cap means has a well extending into said projection, the end of said bulb projecting into said well.

11. In a sprinkler head construction, a frame including conduit means to be connected to a source of water under pressure, said frame also including a pair of arms extending outwardly from said conduit means and being connected together at a junction, cap means for closing said conduit means, releasable means interconnecting said cap means and said junction and constructed and arranged to be released when exposed to a predetermined elevated temperature, said cap means having an upstream facing surface and having a projection extending upstream from said surface, said conduit means including a section having an internal tapered wall that diverges outwardly in an upstream direction, an ejection device including a base section connected to said projection and including an elongated skirt extending longitudinally in an upstream direction from said base section, said skirt diverging outwardly at an angle of divergence to the axis of said conduit means and having a distal end located adjacent said tapered wall whereby downstream movement of said cap means under the influence of water pressure will cause said distal end to engage said tapered wall to tilt said skirt and said cap.

12. The construction of claim 11, wherein the angle of divergence of said skirt from the axis of said conduit means is greater than the angle of divergence of said tapered wall from said axis.

13. The construction of claim 11, wherein said skirt is partially cylindrical in configuration.

14. In a sprinkler head construction, a frame including conduit means to be connected to a source of water under pressure, said frame also including a pair of arms extending outwardly from said conduit means and connected together at a junction, sealing means for closing said conduit means, releasible means responsive to a predetermined elevated temperature for releasing said sealing means from said conduit means, said sealing means including a generally cylindrical section disposed within said conduit means, and an ejection device having a generally cylindrical base disposed concentrically of said cylindrical section, said ejection device also including a skirt connected to said base and disposed within said conduit means, said skirt extending through an arc of approximately 180° and comprising a pair of overlapping arcuate skirt sections disposed in contiguous relation, said skirt sections having longitudinal side edges joined together.

15. The construction of claim 14, and including means for preventing axial movement of said base relative to said cylindrical section.

16. The construction of claim 15, wherein said means for preventing axial movement comprises a circumferential groove formed in said cylindrical section and a crimp projecting radially inward from said base and engaged with said groove.

17. The construction of claim 14, and including means for preventing relative rotation between said base and said cylindrical section.

18. The construction of claim 17, wherein said means for preventing relative rotation comprises a plurality of surface deviations on an outer surface of said cylindrical section and engaged with an inner surface of said base.

* * * * *